US008178780B2

(12) United States Patent
Hjortstam et al.

(10) Patent No.: US 8,178,780 B2
(45) Date of Patent: May 15, 2012

(54) ELECTRIC INSULATION MATERIAL, AN ELECTRIC DEVICE COMPRISING THE INSULATION MATERIAL AND A TRANSFORMER

(75) Inventors: Olof Hjortstam, Vasteras (SE); Rongsheng Liu, Vasteras (SE); Albert Jaksts, Vasteras (SE); Gunilla Eken, legal representative, Vasteras (SE); Leif A. Pettersson, Vasteras (SE)

(73) Assignee: ABB Research Ltd. (CH)

( * ) Notice: Subject to any disclaimer, the term of this patent is extended or adjusted under 35 U.S.C. 154(b) by 37 days.

(21) Appl. No.: 12/825,011

(22) Filed: Jun. 28, 2010

(65) Prior Publication Data

US 2011/0030987 A1 Feb. 10, 2011

Related U.S. Application Data

(63) Continuation of application No. PCT/EP2008/066209, filed on Nov. 26, 2008.

(30) Foreign Application Priority Data

Dec. 27, 2007 (EP) ..... 07124090

(51) Int. Cl.
*H01B 17/34* (2006.01)

(52) U.S. Cl. ..... 174/25 R; 174/25 C

(58) Field of Classification Search ..... 174/110 R, 174/113 R, 117 R, 117 F, 117 FF, 119 R, 174/120 R, 121 B, 120 C, 110 SR
See application file for complete search history.

(56) References Cited

U.S. PATENT DOCUMENTS

| | | | | | |
|---|---|---|---|---|---|
| 3,170,027 | A | * | 2/1965 | Ford | 174/17 R |
| 3,246,271 | A | * | 4/1966 | Ford | 336/94 |
| 3,587,168 | A | * | 6/1971 | Kolator | 29/605 |
| 3,611,225 | A | * | 10/1971 | Dakin | 336/58 |
| 3,710,293 | A | * | 1/1973 | Lazor | 336/198 |
| 4,109,375 | A | * | 8/1978 | Lin et al. | 29/605 |
| 4,204,087 | A | * | 5/1980 | Lin et al. | 174/120 SR |

FOREIGN PATENT DOCUMENTS

| | | | | |
|---|---|---|---|---|
| EP | 0272497 | A2 | | 6/1988 |
| EP | 0889485 | A1 | | 1/1999 |
| JP | 59-211208 | A | * | 11/1984 |
| JP | 59211208 | A | | 11/1984 |
| WO | 0191135 | A1 | | 11/2001 |
| WO | WO 01/91135 | A1 | * | 11/2001 |

OTHER PUBLICATIONS

European Office Action; Application No. EP 07 124 090.7; Mar. 4, 2010; 3 pages.

(Continued)

*Primary Examiner* — William Mayo, III
(74) *Attorney, Agent, or Firm* — St. Onge Steward Johnston & Reens LLC

(57) ABSTRACT

An electric insulation material for an electric device includes one or several electrical conductors and an electric insulation material arranged around the conductor or between the conductors, which insulation material is impregnated with a dielectric insulation liquid. The electric insulation material includes a main layer that is provided with a surface layer that has a dielectric constant that is lower than the dielectric constant of the main layer.

8 Claims, 2 Drawing Sheets

OTHER PUBLICATIONS

O'Sullivan; "A Model for the Initiation and Propagation of Electrical Streamers in Transformer Oil and Transformer Oil Based Nanofluids"; PhD Thesis, Massachusetts Institute of Technology, USA, May 2007; 4 pages (abstract only).

European Search Report; Application No. 07124090.7-1214; Jun. 5, 2008; 5 pages.

International Preliminary Report on Patentability; PCT/EP2008/066209; Mar. 5, 2010; 7 pages.

International Search Report and Written Opinion of the International Searching Authority; PCT/EP2008/066209; Apr. 8, 2009; 13 pages.

Lundgaard, et al.; "Propagation of Positive and Negative Streamers in Oil with and without Pressboard Interfaces"; IEEE Transactions on Dielectrics and Electrical Insulation, vol. 5 No. 3, Jun. 1998; 1 page (abstract).

* cited by examiner

ELECTRIC INSULATION MATERIAL, AN ELECTRIC DEVICE COMPRISING THE INSULATION MATERIAL AND A TRANSFORMER

CROSS-REFERENCE TO RELATED APPLICATIONS

The present application is a continuation of pending International patent application PCT/EP2008/066209 filed on Nov. 26, 2008 which designates the United States and claims priority from European patent application 07124090.7 filed on Dec. 27, 2007, the content of which is incorporated herein by reference.

FIELD OF THE INVENTION

The present invention relates to an electric insulation material for an electric device, an electric device comprising the electric insulation material and a transformer.

BACKGROUND OF THE INVENTION

In high voltage apparatuses such as high voltage transformers, it is common that the insulation system comprises a fiber based insulation impregnated with an insulating liquid, for example a cellulose based insulation drenched in oil or other dielectric liquid, or insulation based on a thermoplastic polymer, such as polyethylene, with low or essentially closed porosity.

Cellulose based pressboard insulation barriers are normally used in the design of oil filled high voltage (HV) transformers. The purpose of the barriers is to prevent pre-breakdown events such as PD (partial discharge) and electric discharges that may occur on the surface and propagate along the insulation, so called streamers, to develop into breakdown of the insulation system. Normally, a pressboard barrier is designed to be thick enough to prevent an impacting streamer from puncturing the barrier. However, a streamer that does not puncture the barrier may propagate along its surface. A streamer can propagate with different speeds, as a slow mode streamer (2-3 km/s) or a fast event (more than 10 km/s, up to several hundred km/s). For typical transformer designs, a fast propagating streamer along a surface is much more risky than a slow propagating streamer. An example of this is if a transformer is exposed to a lightning impulse of high voltage. Since the duration of the pulse is short (in the order of 50 is) the speed of the propagation strongly affects the likelihood for a full breakdown.

Furthermore, it is known that a fast event occurs for lower voltages along a pressboard surface, compared to what happens in pure oil, see enclosed FIG. 1 (from the article by Lundgaard et al identified below). In this figure is seen how a fast event for the combination oil+pressboard occurs at approximately 250 kV, while the fast event of oil alone does not occur until approximately 350 kV. The velocity of the fast event in oil+pressboard is also much higher. One possible explanation can be that image charges, of the charges in the streamer tip, occur in the pressboard. The force $F_{image}$ from the image charges modifies the streamer shape as the streamer is forced down towards the surface of the pressboard, leading to an enhanced field at the streamer tip, which might promote a transition to fast event. See enclosed FIG. 2 (from the article by Lundgaard et al identified below). This explanation is described in the article "Propagation of Positive and Negative Streamers in Oil with and without Pressboard Interfaces", by Lundgaard, Linhjell, Berg, Sigmond, IEEE Transactions on Dielectrics and Electrical Insulation, vol. 5 No. 3, Jun. 1998.

From the above it is clear that it would be desirable to find means to suppress the onset of fast event along a pressboard surface.

As additional literature explaining how a streamer propagates in oil, it is hereby referred to "A Model for the Initiation and Propagation of Electrical Streamers in Transformer Oil and Transformer Oil Based Nanofluids", Francis O'Sullivan, PhD Thesis, Massachusetts Institute of Technology, USA, May 2007.

SUMMARY OF THE INVENTION

The object of the present invention is to provide an electric insulation material that is suitable for use in electric devices comprising one or several electrical conductors and an electric insulation material arranged around the conductor or between the conductors and which insulation material is impregnated with a dielectric insulation liquid, and which material has the capability to suppress the onset of fast events. In particular, it is the object of the present invention to offer a high voltage transformer where the risk for occurrence of streamers and fast events are reduced.

The object of the present invention is achieved by means of an electric insulation material in that the electric insulation material comprises a main layer that is provided with a surface layer that has a dielectric constant that is lower than the dielectric constant of the main layer, an electric device in that it comprises an electric insulation material, and a transformer in that an electric insulation material is used as an insulation barrier in regions with high electrical stress. Accordingly, an electric insulation material for an electric device comprising one or several electrical conductors and an electric insulation material arranged around the conductor or between the conductors and which insulation material is impregnated with a dielectric insulation liquid, characterized in that the electric insulation material comprises a main layer that is provided with a surface layer that has a dielectric constant that is lower than the dielectric constant of the main layer.

By coating a main layer with a layer of material with a dielectric constant that is lower than that of the main layer, the lower value of the dielectric constant at the surface, where it is in contact with the dielectric insulation liquid, would reduce the image force and it should therefore suppress transition to fast event. This type of layered material would suppress the streamer propagation along the surface without any significant changes to the good puncture inhibition properties, in for example the pressboard barrier of a transformer.

According to an aspect of the invention, the dielectric constant of the surface layer is at least 0.3 below the dielectric constant of the main layer.

It should be noted that when it is referred to the dielectric constant of the insulation material, that would mean the dielectric constant of the impregnated insulation material in the electric device. The dielectric constant of a certain material is influenced by the type of dielectric liquid that it is impregnated with and which is used in the device. One common type of dielectric insulation liquid is mineral oil, which has a dielectric constant ($\epsilon$) of approximately 2.2. Other possible insulation liquids are esters ($\epsilon$ in the order of 3.0), silicon oil etc.

According to another aspect of the invention, the surface layer has a thickness of at least 10 μm. The thickness of the surface layer should preferably be at least of the same size as a typical streamer diameter. This would in many cases mean a thickness of 10-40 μm, or 20-40 μm. Thicker surface layers are required to ensure robustness against the occasional discharge that may impact the surface, as well as general wear and tear.

In applications where the insulation material is used as an insulation barrier between windings or between winding and earth, such as in a transformer, as an example the thickness of the entire insulation barrier may be in the range of 1-3 millimeters. A suitable surface layer would then have a thickness of 10-1000 μm.

As another example can be described a turret insulation in that region of a transformer where a transformer bushing connects to the transformer. In such an application, the insulation barrier is built as a cylinder with high density pressboard and waved pressboard in alternating layers up to a total insulation thickness ranging from a couple of decimeters up to a meter, sometimes even more. A suitable range for the thickness of the surface layer would then be 10-5000 μm. When considering the possibility of different applications and also considering practical aspect of achieving the surface layer, a general range of thickness of 40-5000 μm, or 100-5000 μm is a reasonable choice.

According to an aspect of the invention, the main layer comprises a material chosen from the following:

a cellulose based material
a polymeric material
an epoxy resin impregnated material
a rubber material.

An example of a cellulose based material is a high density pressboard. An example of a polymeric material is Nomex, which is a fiber based polymeric material, and an example of an epoxy material is fiber glass reinforced epoxy. When choosing the main material, consideration should be taken to the type of dielectric insulation liquid that is to be used and also the combination with the surface material.

According to an aspect of the invention, the surface layer comprises a material chosen from the following:

a cellulose based material
a polymeric material
an epoxy resin impregnated material
a rubber material.

Examples of cellulose based materials are low density pressboard, waved pressboard, Kraft paper, crepe paper.

With regard to a polymeric material for the surface layer, it, may be chosen from the following: PE-Poly Ethylene, PP-Poly Propylene, PS-Poly Styrene, Fluorinated polymers. Examples of possible Fluorinated polymers are PTFE-Poly Tetraflouroethylene, FEP-Flourinated Ethylene Propylene, PFA-Perflouro Ethylene.

According to the present invention is further defined an electric device comprising one or several electrical conductors and an electric insulation material arranged around the conductor or between the conductors and which insulation material is impregnated with a dielectric insulation liquid, characterized in that it comprises an electric insulation material as defined in any one of the claims defining an electric insulation material.

According to a particular embodiment, the electric device is a high voltage electric apparatus.

The invention is also directed to a transformer, characterized in that an electric insulation material according to any one of the claims related to the electric insulation material, is used as an insulation barrier between regions with high electrical stress. With high electrical stress in usually meant above $10^5$ V/m.

BRIEF DESCRIPTION OF THE DRAWINGS

The present invention will now be described in more detail with reference to the enclosed drawings, in which.

DETAILED DESCRIPTION OF THE INVENTION

As an example, an embodiment of the present invention will now be described, in the form of a pressboard barrier suitable for a high voltage transformer.

Figure 3:
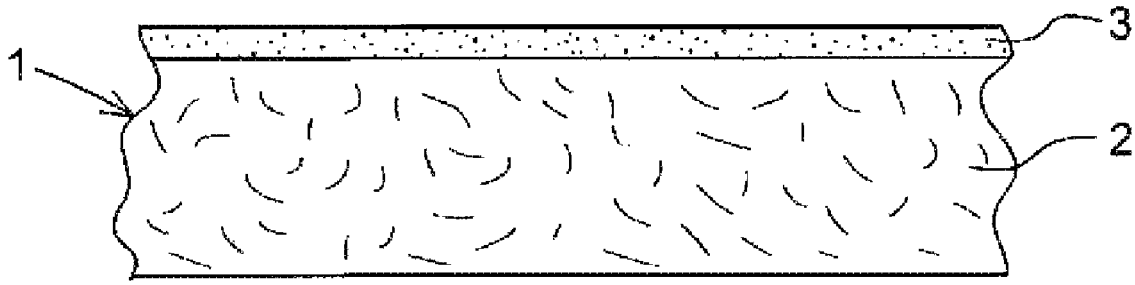
FIG. 3 shows a schematic view of an embodiment of the present invention, in the form of a pressboard, given as example only.

FIG. 3 illustrates an example of an electric insulation material 1 according to the present invention. In this embodiment, the insulation material is a pressboard barrier suitable for use in a high voltage transformer with mineral oil as the insulating liquid. The insulation material comprises a main layer 2, made of a high density pressboard. Typically, the density before impregnation may be between 1.0-1.5 g/cm3. The dielectric constant is typically $\epsilon$=4.0-4.5, even 4.1-4.3, for a high density pressboard impregnated with an insulation liquid such as mineral oil.

The surface layer 3 of the insulation material in the pressboard barrier is made of a low density pressboard, having a typical density of 0.5-1.0 g/cm3. The dielectric constant of this surface layer is lower than for the main layer, preferably in the interval $\epsilon$=2.1-4.0, even 2.1-3.0. A typical dielectric constant for low density pressboard in mineral oil is approximately 3.0. If, as an alternative, crepe paper is used, the dielectric constant would be around 2.8, and if Kraft paper is used the dielectric constant would be 3.4-3.7.

The thickness of the surface layer should be at least of the same thickness as an expected streamer, in the range of 10-1000 μm. In the present case more likely 10-40 μm, or 20-40 μm.

The surface layer may be produced by a coating process, gluing the two pressboard layers together, or any other suitable method, provided that a layer with sufficient thickness is obtained. It is not required that the layers are distinctly separate layers, as long as there is a sufficiently thick surface layer with the required low dielectric constant.

Figure 1:
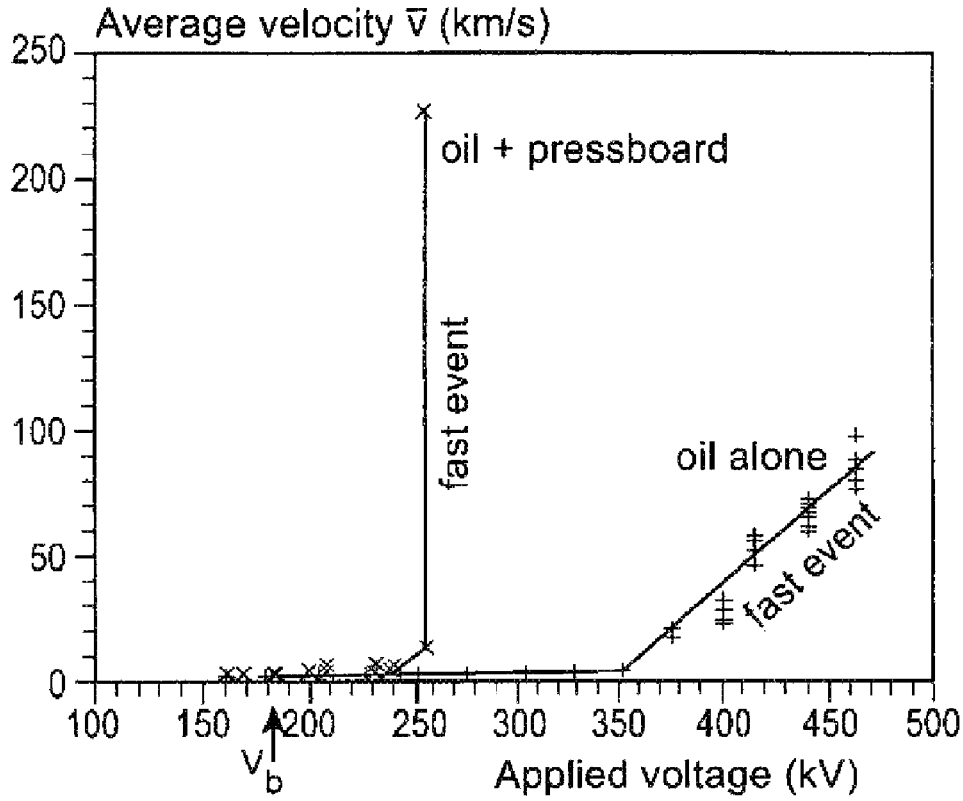
FIG. 1 illustrates the average breakdown velocity at overvoltages, with and without pressboard surface, d=10 cm.
Figure 2:
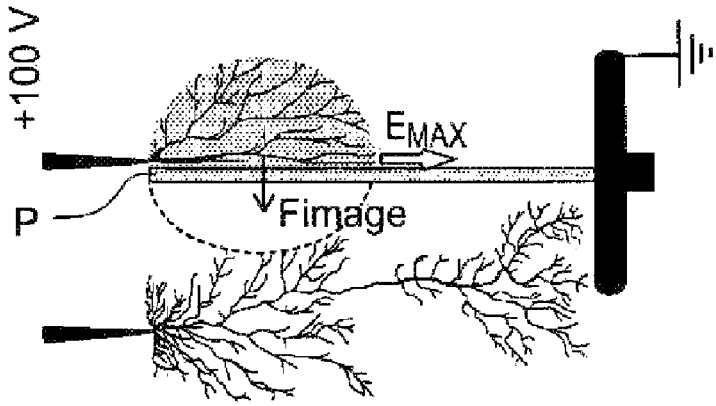
FIG. 2 illustrates the propagation of a streamer along a solid surface, such as a pressboard P; the upper illustration shows the model for a streamer as explained in the referred to article by Lundgaard et al, and the lower illustration shows actual track observed on the pressboard surface.

As mentioned above, this type of layered material would suppress the streamer propagation along the surface without any significant changes to the good puncture inhibition properties. In the article referred to above by Lundgaard et al, tests were made with electrodes where the gap between the electrodes was only in the range of 100 mm. The average breakdown voltage $V_b$, would then occur at a much lower voltage than for the fast event, as can be seen in FIG. 2. This would indicate that the breakdown voltage would be the major concern. However, one inventive aspect of the present invention is that, when comparing with the tests made in Lundgaard, it must be realised that a transformer has a much longer distance between high voltages conductors and earthed parts. When applying the findings of these tests to transformer technology, it can be expected that the breakdown voltage would be clearly higher than for the small scale tests. It is even expected that the breakdown voltage is higher than the voltage when fast event occurs. Consequently, there should be reduced risk for breakdown and puncturing of the insulation barrier system with the present invention.

The present invention is not limited to the described embodiment, given as example only, but can be modified in various ways by a person skilled in the art within the scope as defined in the appended patent claims. For instance, the invention may also be applied to a cable, a generator a condensator, or HV bushing.

What is claimed is:

1. An electric insulation material for an electric device comprising one or several electrical conductors and an electric insulation material arranged around the conductor or between the conductors, and which insulation material is impregnated with a dielectric insulation liquid, characterized in that the electric insulation material comprises a main layer which comprises high density pressboard and that said main layer that is provided with a surface layer comprising a cellulose based material that has a dielectric constant that is lower than a dielectric constant of the main layer.

2. The electric insulation material according to claim 1, characterized in that the dielectric constant of the surface layer is at least 0.3 below the dielectric constant of the main layer.

3. The electric insulation material according to claim 1, characterized in that the surface layer has a thickness of at least 10 μm.

4. The electric insulation material according to claim 3, characterized in that the surface layer has a thickness of 10-5000 μm.

5. An electric device comprising one or several electrical conductors and an electric insulation material arranged around the conductor or between the conductors and which electric insulation material is impregnated with a dielectric insulation liquid, characterized in that the electric insulation material comprises an electric insulation material as defined in claim 1.

6. The electric device according to claim 5, characterized in that the electric device is a high voltage electric apparatus.

7. A transformer, characterized in that an electric insulation material according to claim 1 is used as an insulation barrier in regions with high electrical stress.

8. Electric insulation material according to claim 1, characterized in that the cellulose based surface layer comprises a material chosen from:

low density pressboard,
waved pressboard,
Kraft paper, or
crepe paper.

* * * * *